US010343200B2

(12) United States Patent
Benedetti et al.

(10) Patent No.: US 10,343,200 B2
(45) Date of Patent: Jul. 9, 2019

(54) STEEL PLANT FOR THE PRODUCTION OF LONG METAL PRODUCTS AND CORRESPONDING PRODUCTION METHOD

(71) Applicant: DANIELI & C. OFFICINE MECCANICHE S.P.A., Buttrio (IT)

(72) Inventors: Gianpietro Benedetti, Tricesimo (IT); Giuseppe Bordignon, Bicinicco (IT); Fabrizio Mulinaris, Udine (IT); Alfredo Poloni, Fogliano di Redipuglia (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 452 days.

(21) Appl. No.: 15/027,220

(22) PCT Filed: Oct. 3, 2014

(86) PCT No.: PCT/IB2014/065044
§ 371 (c)(1),
(2) Date: Apr. 4, 2016

(87) PCT Pub. No.: WO2015/049669
PCT Pub. Date: Apr. 9, 2015

(65) Prior Publication Data

US 2016/0243602 A1 Aug. 25, 2016

(30) Foreign Application Priority Data

Oct. 4, 2013 (IT) ..... UD2013A0127

(51) Int. Cl.
*B21B 1/46* (2006.01)
*B21B 39/00* (2006.01)
(Continued)

(52) U.S. Cl.
CPC ..... *B21B 1/463* (2013.01); *B21B 1/46* (2013.01); *B21B 39/004* (2013.01); *B22D 11/00* (2013.01); *B21B 39/20* (2013.01)

(58) Field of Classification Search
CPC ..... B21B 1/46; B21B 1/463; B21B 39/00; B21B 39/004; B21B 39/04; B21B 39/12; B22D 11/1206
See application file for complete search history.

(56) References Cited

U.S. PATENT DOCUMENTS 5,560,095 A 10/1996 Kruger
2008/0028813 A1 * 2/2008 Arvedi ..... B21B 1/463 72/226

(Continued)

FOREIGN PATENT DOCUMENTS

DE 2829063 A1 * 1/1980 ..... B21B 39/004
DE 39 08 457 A1 9/1990

(Continued)

OTHER PUBLICATIONS

International Search Report and Written Opinion for PCT/IB2014/065044, dated Jan. 21, 2015.

*Primary Examiner* — Edward T Tolan
(74) *Attorney, Agent, or Firm* — Marshall, Gerstein & Borun LLP

(57) ABSTRACT

A steel plant for the production of long metal products comprises a continuous casting machine, a rolling mill disposed downstream of the continuous casting machine, and one or more transfer paths for the semifinished cast products, configured to connect the continuous casting machine and the rolling mill. The steel plant also comprises at least one maintenance and/or heating furnace, a discharge plate for the semifinished cast products, and an aerial transfer device.

11 Claims, 7 Drawing Sheets

(51) Int. Cl.
*B22D 11/00* (2006.01)
*B21B 39/20* (2006.01)

(56) References Cited

U.S. PATENT DOCUMENTS

| | | | | |
|---|---|---|---|---|
| 2008/0159836 | A1* | 7/2008 | Thues | B21B 39/004<br>414/331.08 |
| 2010/0077823 | A1* | 4/2010 | Champion | B21B 39/004<br>72/201 |
| 2010/0275667 | A1* | 11/2010 | Seidel | B21B 1/46<br>72/127 |

FOREIGN PATENT DOCUMENTS

| | | | | |
|---|---|---|---|---|
| EP | 0 593 001 | A1 | 4/1994 | |
| EP | 0 770 433 | A1 | 5/1997 | |
| EP | 2 410 272 | A1 | 1/2012 | |
| WO | 2012/101210 | A1 * | 8/2012 | B21B 39/004 |

* cited by examiner

STEEL PLANT FOR THE PRODUCTION OF LONG METAL PRODUCTS AND CORRESPONDING PRODUCTION METHOD

FIELD OF THE INVENTION

The present invention concerns a steel plant and a method for making long metal products such as bars, ribbed bars for reinforced concrete, wire rods, beams or other profiles usable for example in mechanical or civil engineering. In particular, the present invention concerns a combined casting and rolling plant and method, configured for the direct rolling of semifinished continuous cast products according to processes defined as endless and semi-endless.

BACKGROUND OF THE INVENTION

It is known that long metal products, that is having a predominant longitudinal size with respect to the cross section, are normally produced by rolling long semifinished products deriving from continuous casting of the metal, for example steel.

The finished products are generally bars, ribbed bars for reinforced concrete, rods, beams or other profiles, obtained by transforming billets or blooms, with a square, rectangular or round section.

Steel plants are known for the production of long products in which a rolling mill is connected to a continuous casting machine downstream of the latter in a work direction.

In these known plants, a rolling line is located downstream of a continuous casting line, and can be for example aligned and directly coupled with it, defining a co-rolling line, thus without providing intermediate devices, transfer devices, shuttles, translating planes, mobile rollerways or other, which actively move the cast metal, for example translating it in directions transverse to the work direction.

These known plants can perform a production process with no solution of continuity, also known as "endless", in which there is only one semifinished continuous cast product which extends from the zone where the liquid steel solidifies to a zone where it enters into the rolling mill.

The single semifinished product is rolled progressively along the rolling line downstream of the continuous casting line, allowing to reduce the number of entrances over all the stands of the rolling train and hence the probability of cobbles occurring, thus allowing high productivity.

The known combined plant also allows to reduce the compression powers needed in the first portion of the rolling mill, and to exploit the high temperature of the semifinished cast product and to reduce the quantity of cropping cuts, allowing to contain operating costs thanks to increased yield.

Furthermore, a plant provided with a co-rolling line can also perform a semi-endless production process, in which, instead of a single continuous semifinished product, the rolling mill receives, from the continuous casting, material defined by a discrete succession of semifinished products, sheared to size by a shearing unit.

The shearing unit can be used in the starting and stopping phases of the casting machine, for example to perform the head and tail cropping, or when there is a stoppage of the rolling mill, for example following a maintenance intervention or equipping of the plant, or following a cobbles or other problem or inconvenience.

In such situations, where the rolling mill is not able to receive material to be rolled, semifinished cast products are produced, using the shearing unit as above, which have a certain pre-established length and which are then sent to storage areas to be subsequently worked in the rolling mill, once it has been returned to service.

Plants are also known in which two casting lines feed a rolling line downstream of the casting machine and work with a semi-endless process.

With the aim of producing competitive products, there is a strongly felt need to increase the productivity of steel plants, and also to contain waste and energy consumption in order to increase the yield and reduce production costs.

Known combined continuous casting and rolling plants can be limited in this sense, since they are unable to satisfy this requirement, and are greatly affected by stoppages, either programmed or accidental, of the rolling mill.

One purpose of the present invention is to obtain a steel plant and a corresponding method for the production of long metal finished products, which guarantee high productivity and allow to manage and obviate the stoppages of the rolling mill without penalizing the continuous casting and/or the steelworks upstream.

Another purpose of the present invention is to allow to make section changes not only in the continuous casting machine but also in the rolling mill, reducing to a minimum the simultaneous downtimes of the two apparatuses and hence maximizing the use factor of the plant.

Another purpose of the present invention is to maximize the yield of the plant, reducing to a minimum the discards of material, completely recovering the semifinished continuous cast products which in emergency situations are stored in the temporary storage areas.

Another purpose of the present invention is to exploit to the maximum the enthalpy possessed by the original liquid steel, in particular of the semifinished continuous cast products, to contain the running costs and the energy consumption of the plant.

Furthermore, another purpose of the present invention is to obtain a steel plant for the production of long metal products that is flexible, so that it is possible to perform for example a plurality of production steps adaptably to a plurality of different functioning conditions or type of product to be made.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a steel plant according to the present invention, which overcomes the limits of the state of the art and eliminates the defects present therein, comprises a continuous casting machine and a rolling mill aligned with the continuous casting machine and located in direct succession downstream thereof, and one or more transfer paths for the continuous cast products, configured to connect the casting machine and the rolling mill.

According to one aspect of the present invention, the steel plant also comprises at least one maintenance and/or heating furnace to maintain at temperature and/or to heat semifinished cast products, disposed near the transfer paths, a discharge plate for the semifinished cast products, and an aerial transfer device configured to transfer rapidly by aerial path semifinished cast products between the one or more transfer paths, the maintenance and/or heating furnace and/or the discharge plate.

In this way, also by means of the aerial transfer device, the present invention can accumulate or store semifinished cast products in the maintenance and/or heating furnace and, once this is completely full, also in the discharge plate. When possible or envisaged, for example according to a programmed frequency, which may be daily, the semifinished cast products accumulated or stored in the maintenance and/or heating furnace can therefore be transferred rapidly, possibly also by means of the aerial transfer device, toward the rolling line to be rolled.

Consequently, the steel plant and the corresponding production method of the present invention can produce finished long metal products both from the continuous rolling of semifinished cast products directly supplied to the rolling mill with no solution of continuity, and also segments suitably obtained from casting and temporarily accumulated in the maintenance and/or heating furnace or on the discharge plate and subsequently supplied to the rolling mill, once a temperature suitable for rolling has been restored.

Since it can accumulate semifinished cast products, the steel plant according to the present invention has the advantage that it can both reduce the incidence on the casting process and on the steelworks upstream of disadvantages due to possible stoppages, programmed or accidental, of the rolling mill, and can also optimize the productivity, at least daily, of the rolling mill.

The present invention also concerns a method for the production of long metal products, comprising continuous casting, rolling downstream of the continuous casting and transfer of semifinished cast products by means of one or more transfer paths from continuous casting to rolling, which provides to maintain at temperature and/or heat semifinished cast products in a maintenance and/or heating furnace at the one or more transfer paths between casting and rolling, discharging semifinished cast products in a discharge plate, and the rapid transfer by aerial path of semifinished cast products between the one or more transfer paths, the maintenance and/or heating furnace and/or the discharge plate.

One advantage of the method according to the present invention is to limit to a minimum the temperature losses in the transfer of the semifinished cast products from continuous casting to rolling mill, also providing to maintain them at temperature for several hours, so as to reduce the overall loss of energy of the steel plant and improve the efficiency of the rolling process and the quality of the final product.

BRIEF DESCRIPTION OF THE DRAWINGS

These and other characteristics of the present invention will become apparent from the following description of some forms of embodiment, given as a non-restrictive example with reference to the attached drawings wherein.

Figure 1:
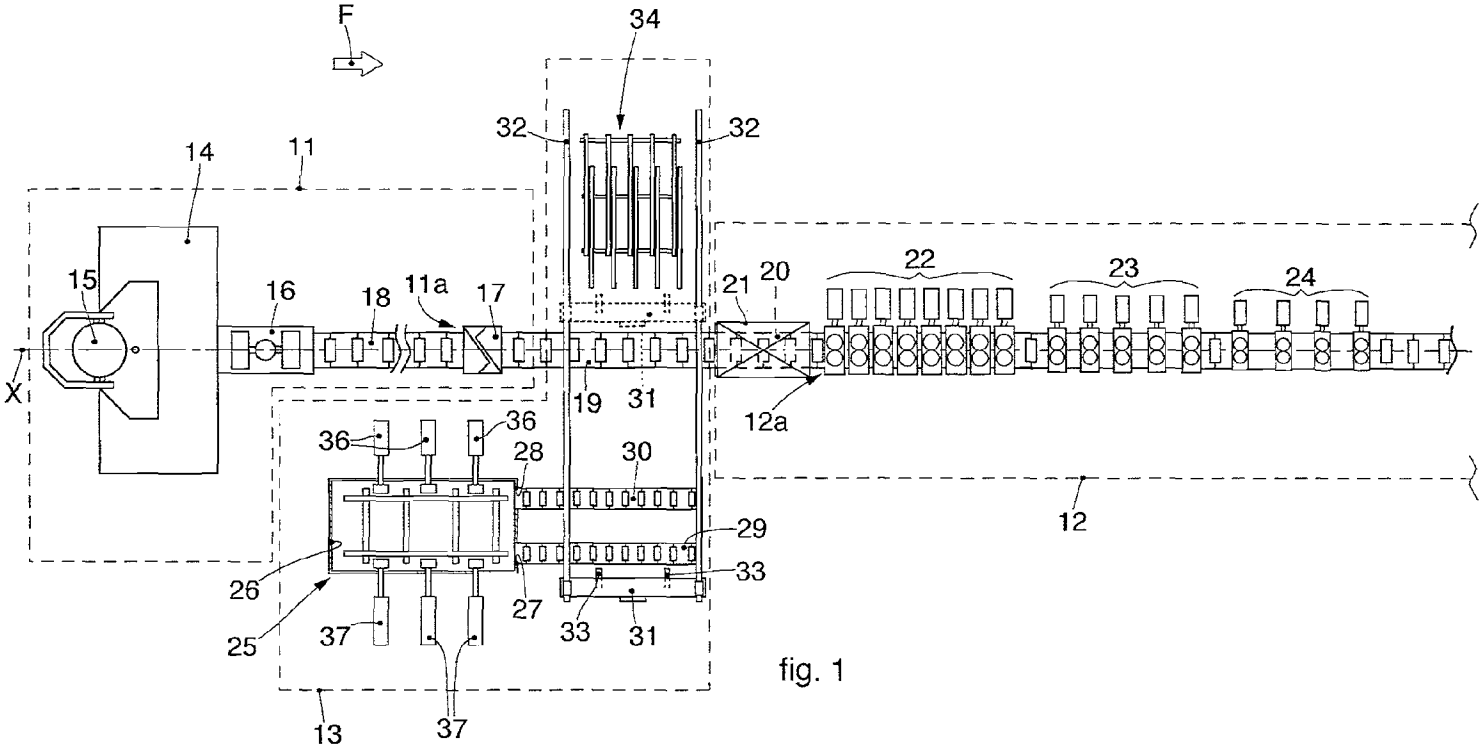
FIG. 1 is a schematic plan view of some forms of embodiment of a steel plant according to the present invention.

In the following description, the same reference numbers indicate identical parts of the steel plant according to the present invention, also in different forms of embodiment. It is understood that elements and characteristics of one form of embodiment can be conveniently incorporated into other forms of embodiment without further clarifications.

DETAILED DESCRIPTION OF SOME FORMS OF EMBODIMENT

We shall now refer in detail to the various forms of embodiment of the present invention, of which one or more examples are shown in the attached drawings. Each example is supplied by way of illustration of the invention and shall not be understood as a limitation thereof. For example, the characteristics shown or described insomuch as they are part of one form of embodiment can be adopted on, or in association with, other forms of embodiment to produce another form of embodiment. It is understood that the present invention shall include all such modifications and variants.

With reference to the attached drawings, a steel plant for the production of long metal products according to the present invention is indicated in its entirety by the reference number 10, and is configured to obtain the solidification of liquid metal, for example steel, in semifinished cast products and to produce long metal rolled products started from said semifinished cast products.

The semifinished products can be blooms or billets with a circular, rectangular square or polygonal section, typically used for the production of bars, ribbed bars, rods, profiles, or they can also be beam-blanks with a substantially H-shaped section for the production of beams or profiles.

Hereafter in the description and possibly in the claims, we shall use the word "billet" to identify any one whatsoever of the semifinished continuous casting products mentioned above.

In some forms of embodiment, the steel plant 10 can reach, for sections worked at maximum speeds, an hourly productivity of about 150 t/h of rolled products, and can even exceed 1-1.5 Mt annual productivity.

The steel plant 10 according to the present invention includes a continuous casting machine 11 and a rolling apparatus or rolling mill 12, positioned downstream of the continuous casting machine 11.

The continuous casting machine 11 and the rolling mill 12 are contiguous and located one in succession to the other in a work direction, or flow direction, indicated in the drawings by the arrow F, which identifies the direction of the flow of material during the casting and rolling process obtained by the steel plant 10.

In some forms of embodiment, the continuous casting machine 11 and the rolling mill 12 also share the same work axis X, so that the semifinished cast products can be received directly by the rolling mill 12. In this way, it is possible to achieve a working process without a solution of continuity, or endless, from casting the liquid steel to obtaining the long rolled metal finished products. In the endless process, the expression "semifinished cast product" means a single billet, having a length that goes from the solidification zone of the continuous casting machine 11 to the entrance to the rolling mill 12. The steel plant 10 is also suitable to effect a semi-endless working process, that is, in which the semi-finished cast products are fed to the rolling mill 12 with a partial solution of continuity.

In the semi-endless process, the rolling mill 12 is fed with segments of a desired length, for example comprised between 12 m and 80 m.

It is understood, however, that for some types of production, for example in semi-endless mode, some forms of embodiment described here may provide that the continuous casting machine 11 and the rolling mill 12 are provided on different work axes, for example parallel to each other, providing intermediate transfer devices for the semifinished cast products.

In some forms of embodiment, combinable with all the forms of embodiment described here, the steel plant 10 also includes one or more transfer paths 19 which connect the casting machine 11 and the rolling mill 12, to transfer the billets between these two sections of the steel plant 10.

In some forms of embodiment, combinable with all the forms of embodiment described here, the steel plant 10 also includes a maintenance and/or heating furnace 25 for the billets, located off-line at the one or more transfer paths 19, a discharge plate 34 to discharge the billets laterally, for example also located at the one or more transfer paths 19, and an aerial transfer device 31 to transfer the billets rapidly, without any substantial loss of temperature or in any case minimizing such loss, between the one or more transfer paths 19, the maintenance and/or heating furnace 25 and/or the discharge plate 34.

The maintenance and/or heating furnace 25 for the billets and the discharge plate 34 can be comprised in an intermediate auxiliary apparatus 13 which can be disposed at the one or more transfer paths 19.

According to the present description, the term "hot billets" means billets, blooms or beam-blanks arriving from the continuous casting machine 11 and typically having temperatures of above 800° C., in some cases even 900° C.

According to the present description, the term "cold billets" means those semifinished cast products which have already completed cooling to ambient temperature, for example because produced and accumulated off-line during previous castings.

Figure 2:
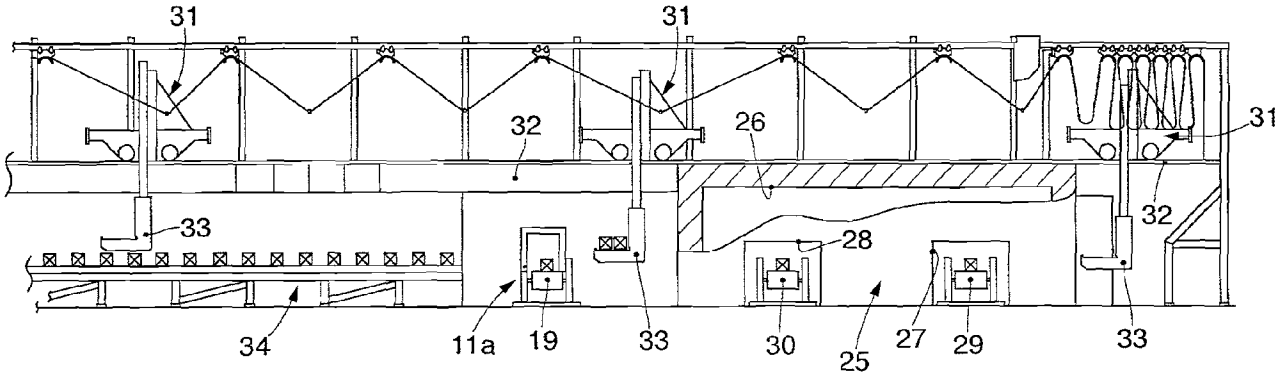
FIG. 2 is a front view of a part of the plant in FIG. 1.

FIGS. 1 and 2 are used to describe forms of embodiment of the steel plant 10 in which the continuous casting machine 11 is provided with a single casting line 11*a*.

The single casting line 11*a* is fed from a tundish 14 in which, for example, molten steel is poured from ladles 15 in a continuous succession.

The desired cross section is conferred on the billet by an ingot mold, cooled externally (not shown in the drawings), typically positioned immediately below the tundish 14 from which it receives the molten steel.

FIGS. 3 to 7 are used to describe forms of embodiment of the steel plant 10 in which the continuous casting machine 11 is provided with at least two casting lines, for example a first casting line 111*a* and a second casting line 111*b*, autonomous and independent with respect to each other; a single tundish 114, common to both the casting lines 111*a*, 111*b*, is provided upstream of the two casting lines 111*a*, 111*b*.

Both the first casting line 111*a* and the second casting line 111*b* depart from the same tundish 114 in which, for example, molten steel is continuously poured from successive ladles 15.

The two casting lines 111*a*, 111*b* can be disposed slightly inclined with respect to each other, that is, divergent from a theoretical median axis (see for example FIGS. 3, 4 and 5), or parallel to each other (see for example FIGS. 6 and 7), as will be explained in more detail hereafter in the description.

Each casting line 111*a*, 111*b* typically includes an ingot mold, not shown in the drawings, configured to obtain the solidification of the outermost layer or skin of the billets and to define the shape of their cross section.

In some forms of embodiment, each casting line, both the single line 11*a* and also the two casting lines first 111*a* and second 111*b*, can also include an extractor unit 16 configured to extract the solidifying billets from the ingot mold continuously and simultaneously, in the case for example of the two casting lines 111*a* and 111*b*.

Proceeding in the work direction F, the billets in the casting machine 11 are progressively solidified, generally by means of forced cooling, for example by water or air-water.

The casting machine 11 can include, for example for each casting line 11*a*, 111*a*, 111*b*, a shearing unit 17, which is configured to intervene, for example, in a semi-endless production process or, for example, in the endless production process if emergencies occur, such as for example a cobble, so that it is necessary to interrupt the rolling process.

The shearing unit 17, which can be the mechanical type, for example a shears, or thermo-chemical, for example an oxyacetylene system with oxyacetylene blow torches, is configured to shear the billets to size, obtaining billets with a pre-determined length, for example from 12 to 16 meters, but also up to 80 meters, suitable to allow them to be stored and subsequently rolled.

Each shearing unit 17 is positioned at the end of a corresponding intermediate transfer path, for example an intermediate transfer path 18, which joins the extractor unit 16 and the shearing unit 17.

With reference for example to forms of embodiment described using FIG. 1, a transfer path 19 is provided, such as for example a path with discharge rolls, configured to connect the continuous casting machine 11 to the rolling mill 12.

The transfer path 19 can be interposed for example between the intermediate transfer path 18 and another transfer path 20, for example a feed roll path of the rolling mill 12, to transfer the billets from the first to the second of said transfer paths 19, 20.

With reference to FIG. 1 for example, the rolling mill 12 is provided with a single rolling line 12*a*, of which the transfer path 20 may constitute the initial segment.

Some forms of embodiment described using FIG. 1 may provide a single casting line 11*a* and a single rolling line 12*a* which are aligned along the work axis X, so that it is possible that, under normal working conditions, the rolling mill 12 rolls the billets directly and without any solution of continuity. In this way the single casting line 11*a* and the single rolling line 12*a* define a co-rolling line configured for an endless work process, without the shearing unit 17 being used.

When, on the contrary, the rolling mill 12 is unable to receive material from the continuous casting machine 11, for example in the event of stoppages in the rolling to perform programmed maintenance of the rolling mill 12, or equipping to change the sections to be produced, or again in the case of accidental events, such as cobbles or malfunctioning, the shearing unit 17 can be activated and can intervene for the production of billets in segments.

After they have been sheared to size, the billets in segments are discharged on each occasion from the single casting line 11*a* when they are present on the transfer path 19.

Some forms of embodiment described using FIG. 1, combinable with all the forms of embodiment described here, can provide that the intermediate auxiliary apparatus 13 is interposed between the continuous casting machine 11 and the rolling mill 12 in correspondence with the transfer path 19.

The intermediate auxiliary apparatus 13 can be configured for example to discharge the billets in segments from the transfer path 19 to send them to a temporary storage zone.

In the same way, the intermediate auxiliary apparatus 13 can for example position the billets in segments on the transfer path 19 for rolling, once the functioning of the rolling mill 12 has been restored.

For example, in forms of embodiment described using FIG. 1, the maintenance and/or heating furnace 25 can be disposed at the side of the continuous casting machine 11 and the rolling mill 12, at the transfer path 19, and the discharge plate 34 disposed on the opposite side, providing the aerial transfer device 31 operating astride the continuous casting machine 11 and the rolling mill 12, to serve the maintenance and/or heating furnace 25 and/or the discharge plate 34 with billets taken from the transfer path 19.

Figure 7:
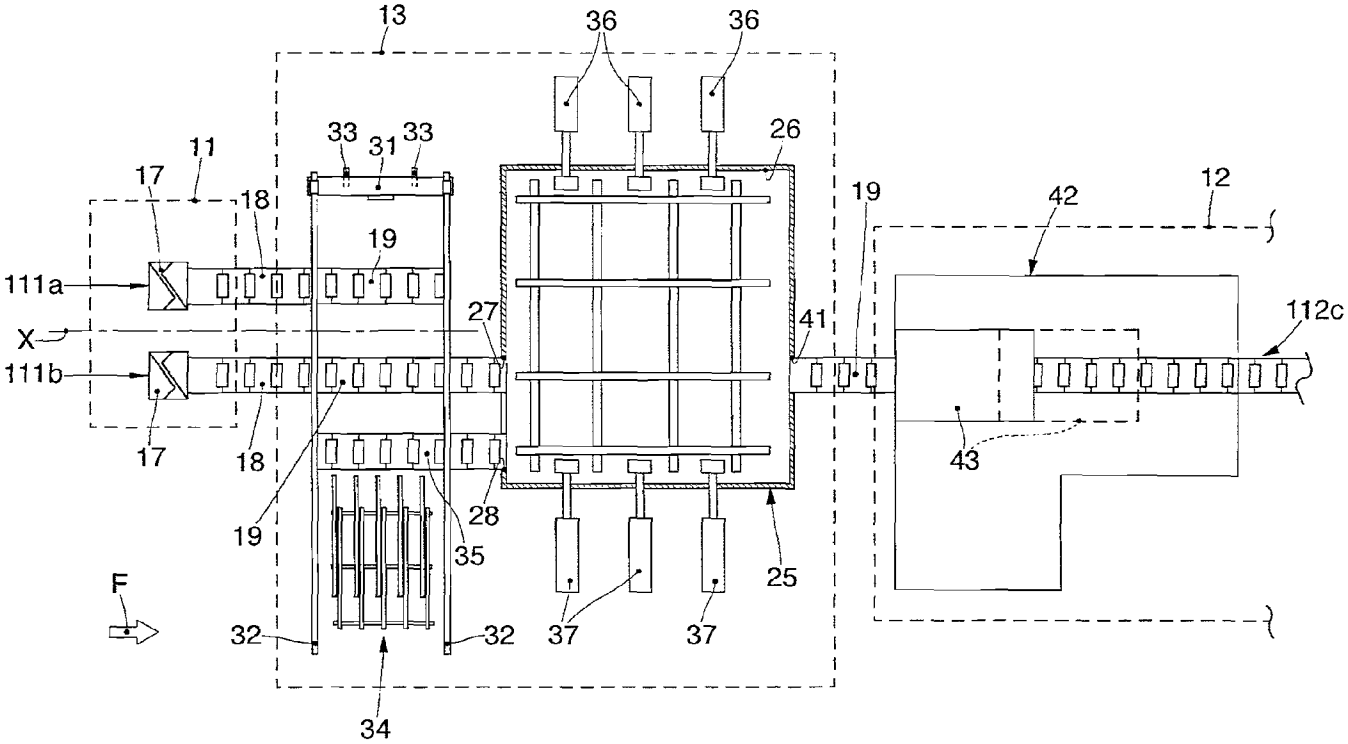
FIG. 7 is an enlarged view of a part of the steel plant according to other forms of embodiment of the present invention.

In other forms of embodiment, the maintenance and/or heating furnace 25 can be at least partly overlapping the transfer path 19 between the continuous casting machine 11 and the rolling mill 12, as described for example hereafter using FIG. 7.

In the event, for example, that the steel plant 10 is functioning normally in an endless process, the billet arriving from the intermediate transfer path 18 of the continuous casting machine 11 passes through the intermediate auxiliary apparatus 13 on the transfer path 19 and is moved through induction furnaces 21 by said transfer path 20.

In the case for example of semi-endless or discontinuous functioning, the induction furnaces 21 receive billets in segments.

In any case, the induction furnaces 21, typically located downstream of the intermediate auxiliary apparatus 13, can be configured for example to heat the billet up to a start-of-rolling temperature, normally comprised between 1050° C. and 1200° C.

The transfer path 20 is configured to convey the billet toward a roughing train 22, in which the first deformations of the billet are performed. Typically, the roughing train 22 can define a preliminary working zone of the rolling mill 12, upstream of the finishing, as explained in more detail hereafter.

In some forms of embodiment, downstream of the roughing train 22, the rolling mill 12 includes an intermediate rolling train 23 which is configured to shape the product exiting from the roughing train 22 in successive deformation passes that allow to obtain a product with an intermediate cross section between the final cross section of the rolled product and the initial cross section of the cast billet.

Downstream of the intermediate train 23, the rolling mill 12 includes a finishing rolling train 24, which is configured to perform one or more rolling operations for finishing and obtaining the final rolled product.

The rolling mill 12 can also include, downstream of the finishing train 24, movement, collection and storage apparatuses of the rolled products.

Figure 3:
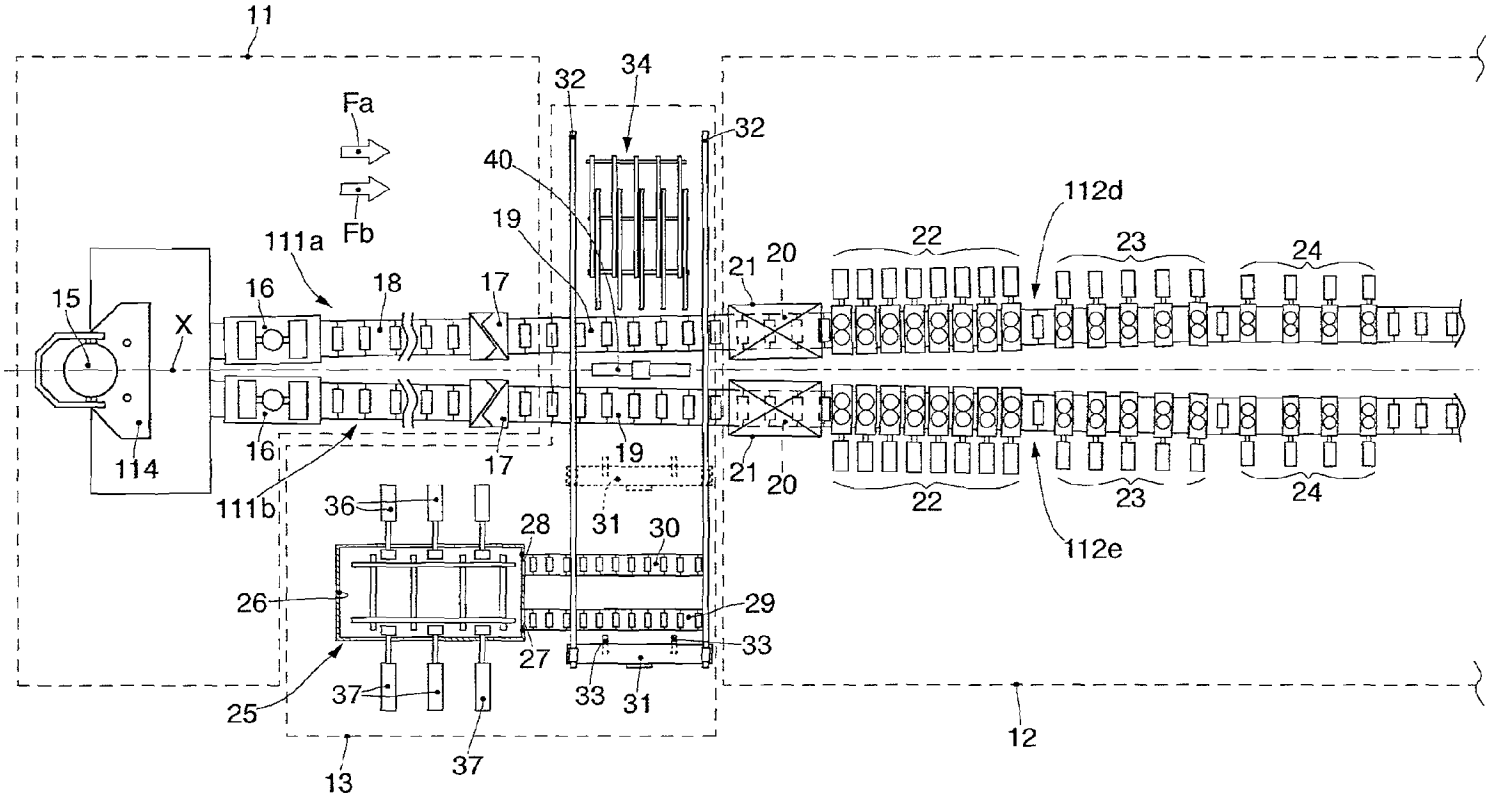
FIG. 3 is a schematic plan view of other forms of embodiment of a steel plant according to the present invention.

FIG. 3 is used to describe forms of embodiment, combinable with all the forms of embodiment described here, in which the two casting lines 111*a*, 111*b* are inclined with respect to each other, in particular they are reciprocally divergent on an horizontal plane with respect to a common median axis, and define respective work directions Fa and Fb.

With reference to FIG. 3, forms of embodiment are described by way of example in which the two casting lines 111*a*, 111*b* are both inclined in a reciprocally specular manner with respect to the work axis X.

Solutions can also be provided in which the casting lines 111*a*, 111*b* are asymmetrically inclined with respect to the work axis X, or solutions in which only one of the casting lines 111*a*, 111*b* is inclined and one is parallel to the work axis X.

Figure 6:
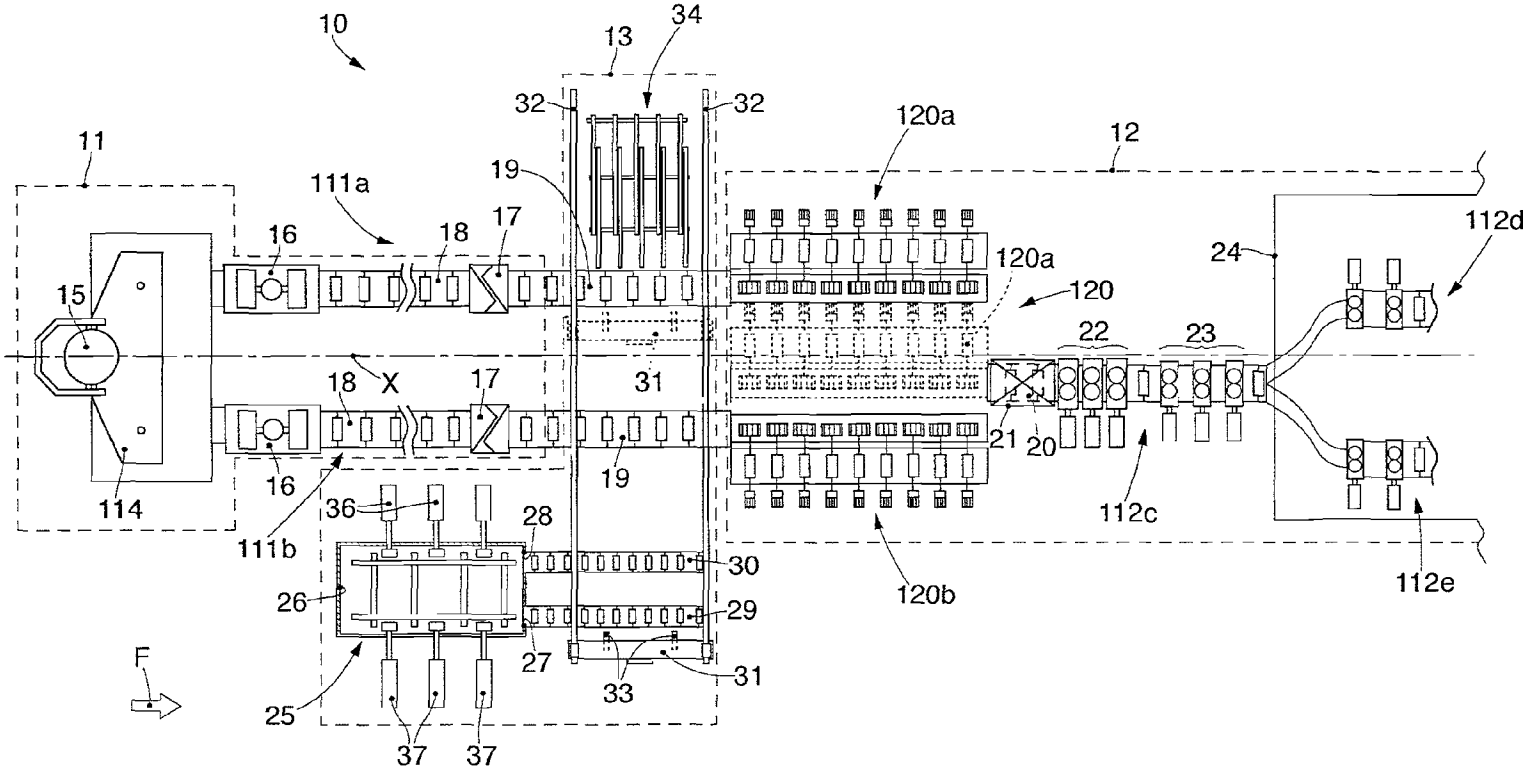
FIG. 6 is a plan view of other forms of embodiment of a steel plant according to the present invention.

FIGS. 6 and 7 are used to describe other forms of embodiment, in which the first casting line 111*a* and the second casting line 111*b* are both parallel to the work axis X and therefore aligned parallel to each other.

In the forms of embodiment described by way of example with reference to FIGS. 3 to 7, two transfer paths 19 are provided for connecting each of the first 111*a* and second 111*b* casting lines of the casting machine 11 and the rolling mill 12.

With reference to FIGS. 3, 6 and 7, the intermediate auxiliary apparatus 13 is interposed, as described for example with reference to FIG. 1, between the continuous casting machine 11 and the rolling mill 12. In these forms of embodiment, the intermediate auxiliary apparatus 13 can include a pair of said transfer paths or discharge roll paths 19.

Each transfer path 19 can be aligned to one of the intermediate transfer paths 18 of the casting lines 111*a*, 111*b* and to a transfer path 20 of the rolling mill 12.

The rolling mill 12 can include, as for example in the forms of embodiment described by way of example using FIG. 3, two rolling lines, specifically a first rolling line 112*a* and a second rolling line 112*b*, autonomous and independent with respect to each other, and therefore two transfer paths 20, one for each rolling line 112*a*, 112*b*.

The first rolling line 112*a* and second rolling line 112*b* can therefore be aligned respectively to the first casting line 111*a* and the second casting line 111*b*.

Consequently, if the casting lines 111*a*, 111*b* are reciprocally inclined, also the rolling lines 112*a*, 112*b* are reciprocally inclined, and if the casting lines 111*a*, 111*b* are parallel, so then too the rolling lines 112*a*, 112*b* are parallel.

FIGS. 6 and 7 are used to describe forms of embodiment of the steel plant 10 in which the rolling mill 12 includes a single rolling segment 112*c* that extends from the transfer paths 19 of the intermediate auxiliary apparatus 13 as far as the finishing train 24 of the rolling mill 12.

In possible implementations (FIG. 6), the single rolling segment 112*c* can have a longitudinal development parallel to or coincident with the work axis X, whereas in other implementations (FIG. 7) it can be aligned with the first casting line 111*a* or the second casting line 111*b*.

The finishing train 24 can be configured to finish the rolled products on two finishing lines 112*d* and 112*e*, substantially parallel and independent of each other.

In some forms of embodiment, such as those described by way of example with reference to FIG. 6, where there is said single rolling segment 112*c*, the rolling mill 12 can also include a feed device or feed shuttle 120, interposed between the transfer paths 19 of the intermediate auxiliary apparatus 13 and the single transfer path 20 of the rolling mill 12.

The feed shuttle 120 is configured to dispose the billets arriving from the transfer paths 19 on the transfer path 20, to feed the induction furnaces 21.

The feed shuttle 120 can be defined by segments provided with rolls for moving the billets, mobile in a transverse direction, for example orthogonal, to the work axis X.

With reference for example to the forms of embodiment described using FIG. 6, the feed shuttle 120 can include a mobile segment 120*a*, which receives billets from the transfer path 19 of the first casting line 111*a*, and a mobile segment 120*b*, which receives billets from the transfer path 19 of the second casting line 111*b*.

Both segments 120*a*, 120*b*, once they have received the billets, are configured to translate, so as to direct the billets to the transfer path 20, and are configured to subsequently retreat, re-aligning with the respective casting line 111*a*, 111*b*.

In possible additional implementations, or as an alternative to the operating modes described above, it may be provided that the rolling mill 12 is fed with billets arriving from a temporary storage zone and hence not directly, and without solution of continuity after solidification and shearing to size, from the continuous casting machine 11.

In some forms of embodiment, the temporary storage zone can be included in the intermediate auxiliary apparatus 13.

The intermediate auxiliary apparatus 13 can include the maintenance and/or heating furnace 25, configured for example to maintain the billets hot and to heat the cold billets to a stand-by temperature. Typically, the maintenance and/or heating furnace 25 can be low consumption and can be configured to operate at relatively low temperatures (about 900° C.) so as to allow the billets to remain inside for some time, advantageously limiting the formation of scale.

The stand-by temperature to which the cold billets can be heated is typically high enough, for example at least ⅔ the rolling temperature, so as to advantageously limit the heating times in the induction furnaces 21 downstream and, as we said, low enough to limit the formation of scale.

In some forms of embodiment, such as those described using FIGS. 1 to 6, the maintenance and/or heating furnace 25 can be positioned laterally and externally with respect to the casting lines 11*a*, 111*a*, 111*b*, or, as described with reference to FIG. 7, it can overlap one or more transfer paths 19 between one casting line 111*b* (or 111*a*) or both, and the rolling mill 12.

The maintenance and/or heating furnace 25 (see for example FIG. 2) can be provided with an internal chamber 26 with an amplitude such as to contain at least 16 billets, and typically made of refractory and internally heated to maintain inside it a temperature of not less than about 900° C.

Advantageously, in possible forms of embodiment, the maintenance and/or heating furnace 25 can be configured for an accumulation capacity, or buffer-time, such as to contain for example a number of billets equal in weight to a steel ladle of 70 tons, for example 20 billets 16 meters long with a square cross section of 165 mm per side.

As we said, in possible forms of embodiment, not restrictive of the field of protection of the present invention, at exit from the maintenance and/or heating furnace 25, or in any case downstream thereof, there may be the cited induction furnace 21, configured to take the temperature of the billets to values suitable for rolling, at least if the temperature at exit from the furnace is for example about 1050° C. or lower.

With its action, the induction furnace 21 can allow a greater uniformity in heating the billets, in particular for example to heat their edges, thus preventing the formation of cracks in these zones during rolling.

In some forms of embodiment, the maintenance and/or heating furnace 25 can be provided with an entrance aperture 27 to introduce the billets into the internal chamber 26, and an exit aperture 28, to discharge the billets from the internal chamber 26.

The introduction can be carried out by means of an introduction path 29, for example an introduction rolls path, configured to receive and introduce billets to the internal chamber 26, while a discharge path 30, for example a discharge rolls path, can be provided to perform said discharge, in particular configured to pick up and discharge billets from the internal chamber 26.

In some forms of embodiment, with reference for example to FIGS. 1, 3, 4, 6 and 7, one or more thrust heads 36 may be provided, configured to feed the billets to the maintenance and/or heating furnace 25, and also, subsequently, to remove them.

Furthermore, in possible other implementations, one or more counter-thrust heads 37 may be provided, configured to empty the maintenance and/or heating furnace 25 from inside.

In possible forms of embodiment, combinable with all the other forms of embodiment described here, the intermediate auxiliary apparatus 13 can include the aerial transfer device 31. For example, the aerial transfer device 31 can be the rapid type, that is, configured to obtain a rapid aerial transfer of the billets.

According to the present description, the term "rapid aerial transfer" means a transfer effected with a translation speed comprised between 90 and 120 m/min and a vertical ascent/descent speed comprised between 7.5 and 20 m/min, preferably 15 m/min.

The speed of the aerial transfer device 31 is intended to transfer the billets rapidly and thus to limit to a minimum the losses of time and temperature that can occur during the movement of the billets.

The aerial transfer device 31 can be made slidable, for example along rectilinear guides 32 disposed transverse, for example orthogonal, to the work axis X.

Figure 5:
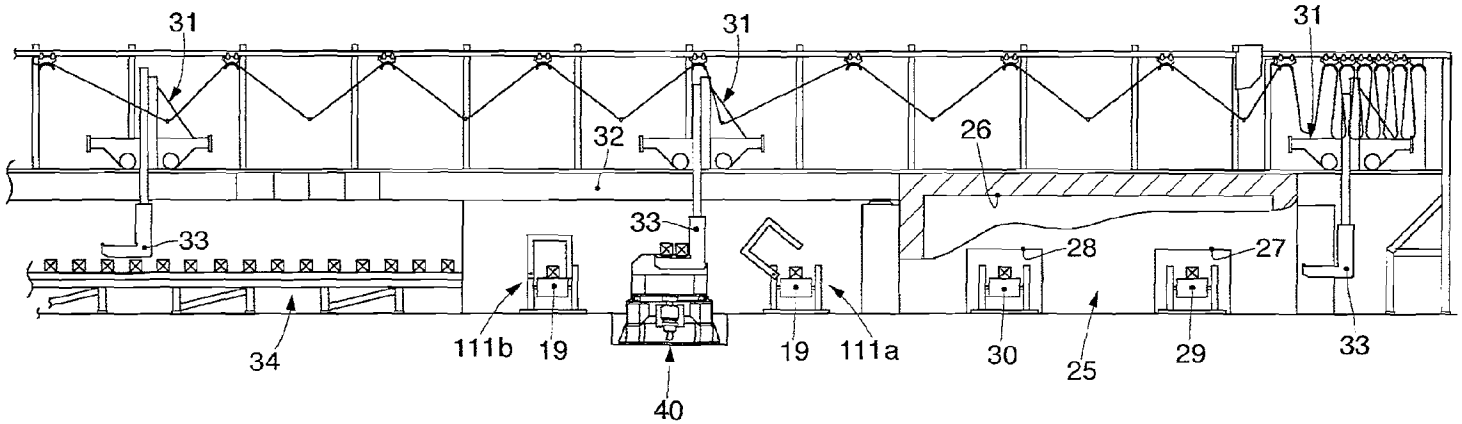
FIG. 5 is a front view of the part in FIG. 4.

Furthermore, the aerial transfer device 31 can be configured to translate above the transfer paths 19, the introduction paths 29 and discharge paths 30 (FIGS. 2 and 5).

In this way, the aerial transfer device 31 can assume different operating positions transverse to and above the casting lines 11*a*, 111*a*, 111*b*, for example to pick up the billets from the transfer paths 19 and position them on the introduction path 29 so that they are sent for maintenance or heating.

In the same way, the aerial transfer device 31 can pick up the billets from the discharge path 30 and position them on the transfer paths 19 so that they are sent for rolling in the rolling mill 12.

For example, in forms of embodiment described using FIGS. 2 and 5, the aerial transfer device 31 is configured to assume for example at least three different operating positions.

The aerial transfer device 31 is configured to pick up the billets using gripping and holding means, which can comprise gripping and support forks 33, or grippers or magnetic devices, or similar or comparable gripping and support members.

The gripping and support forks 33 can be configured translatable vertically to assume at least a high position of non-interference, a low position for picking up and releasing the billets, and an intermediate position for moving them.

In some forms of embodiment, combinable with all the other forms of embodiment described here, the intermediate auxiliary apparatus 13 can also include the discharge plate 34, configured to receive the billets and which can therefore function as a temporary storage zone as described above. The discharge plate 34 can be positioned for example externally and laterally with respect to the transfer paths 19, for example in proximity to them. For example, in forms of embodiment where the maintenance and/or heating furnace 25 is at the side of the single casting line 11*a* (FIGS. 1 and 2) or the two casting lines 111*a*, 111*b* (FIGS. 3-6), the discharge plate 34 can be positioned on the side of the casting line/lines 11*a*, 111*a*, 111*b* opposite the maintenance and/or heating furnace 25.

In particular, the discharge plate 34 can be used when the maintenance and/or heating furnace 25 has been completely filled with billets and it is necessary to receive other semi-finished cast products arriving from the continuous casting machine 11. Typically, the billets located on the discharge plate 34 cool and, when the space available on the plate is finished, they can be removed and stored in a collection zone for semifinished cast products, not shown in the drawings.

In some forms of embodiment, the aerial transfer device 31 can be configured to serve the discharge plate 34 as well, that is, not only to transport billets to the discharge plate 34, but also to remove billets from the discharge plate 34. In possible implementations therefore, the aerial transfer device 31, affecting with its action the space that goes from the maintenance and/or heating furnace 25 to the discharge plate 34, is configured to selectively move from the maintenance and/or heating furnace 25 to the discharge plate 34, passing above the casting line/lines 11*a*, 111*a*, 111*b*, so as to move the billets as required.

Figure 4:
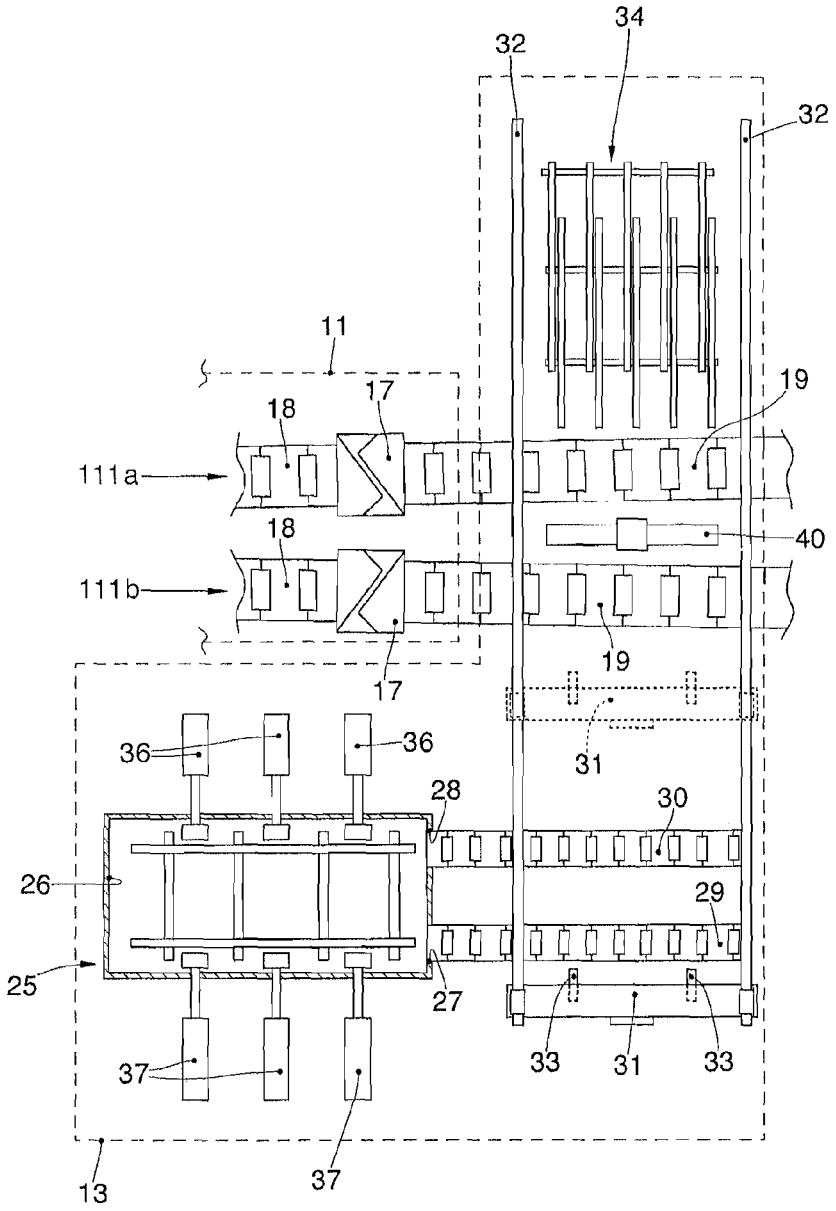
FIG. 4 is an enlarged view of part of the steel plant in FIG. 3.

In possible forms of embodiment, described for example with reference to FIGS. 3, 4 and 5 where the casting lines 111*a*, 111*b* are both inclined, for example divergent, or only one is inclined and the other is parallel to the work axis X, a billet-turner device 40 may be provided, configured to receive the billets and to direct them so that their main direction of development is aligned with the specific work direction F of the rolling line 112*a*, 112*b* which subsequently rolls them.

Consequently, the billets can be transported by the aerial transfer device 31, for example picked up from the intermediate auxiliary apparatus 13, the maintenance and/or heating furnace 25 or the discharge plate 34, which rests them on the billet-turner device 40. The latter is configured to rotate the billets in the same direction as the rolling line in which the aerial transfer device 31 will subsequently have to move the billets for their subsequent rolling.

As explained above, FIG. 7 is also used to describe forms of embodiment in which the maintenance and/or heating furnace 25 is disposed overlapping one or more transfer paths 19 between one casting line, for example indicated by the reference number 111*b*, although the description also applies to the casting line 111*a*, or to both casting lines 111*a*, 111*b* and the rolling mill 12.

In possible implementations, a single movement path 35 may be provided, for example with rolls, configured to receive and supply billets to/from the aerial transfer device 31 and to/from the maintenance and/or heating furnace 25. The movement path 35 can be configured to introduce the billets received inside the maintenance and/or heating furnace 25 and also to discharge them from the maintenance and/or heating furnace 25 and make them available to the aerial transfer device 31.

In possible implementations of these forms of embodiment, the maintenance and/or heating furnace 25 can be provided with an exit door 41, positioned on the opposite side of the maintenance and/or heating furnace 25 with respect to the entrance aperture 27 and cooperating with the transfer path 20.

In this way, both the second casting line 111*b* and the single rolling segment 112*c* are aligned and directly connected, in practice determining a co-rolling line suitable to perform for example an endless process in which only the second casting line 111*b* is active.

If both the casting lines 111*a*, 111*b* are active, a semi-endless process can be carried out for example, in which the billets in segments of the first line 111*a* are picked up by the aerial transfer device 31 from the corresponding transfer path 19 and positioned on the movement path 35 and made to enter into the maintenance and/or heating furnace 25.

The counter-thrust heads 37 are thus configured to move the billets inside the maintenance and/or heating furnace 25 and to align them with the transfer path 20 to be processed later in the rolling mill 12.

Downstream of the maintenance and/or heating furnace 25 a billet-welder device 42 may be provided, as described by way of example using FIG. 7. The billet-welder device 42 is configured to weld the successive billets in segments with respect to each other before the roughing train 22 and, in practice, to recreate a functioning condition analogous to the endless condition.

In some forms of embodiment, the billet-welder device 42 can be provided with a mobile welding member 43 which, moving along the work direction F at the same speed as the billets, allows to weld the billets without having to stop them, or so-called welding on the fly, and hence without affecting the productivity of the plant or the enthalpy content of the billets.

Some forms of embodiment described here also concern production methods which provide to obtain a finished product with the combined high-productivity casting and rolling steel plant 10 as described heretofore. Some forms of embodiment of the production method can be configured to effect a daily rolling sequence, that is, based on 24 hours.

In some forms of embodiment, the flow of material in the work direction F can be continuous, for example, and without discontinuity or interruptions between the continuous casting machine 11 and the rolling mill 12, in order to exploit to the utmost the energy content of the liquid steel and to make the rolling mill 12 work to maximum yield.

In possible cases where the rolling mill 12 is not able to process the material, for example following incidents or programmed stoppages, then the continuous flow may be interrupted.

In this situation, since it is not convenient to stop the casting and the steelworks upstream, until the rolling mill 12 is operating again it is necessary to form said billets sheared to size, which are still at high temperature, which high temperature is not to be dispersed but, on the contrary, should advantageously be preserved, at least until the rolling mill 12 starts operating again. To this purpose, as described above, according to some forms of embodiment of the present invention, the cited maintenance and/or heating furnace 25 may be provided in proximity to the casting lines 11*a*, 111*a*, 111*b*, for example at the side of them (FIGS. 1-6) or partly or completely overlapping one or more transfer paths 19 between the casting lines 11*a*, 111*a*, 111*b* and the rolling mill 12 (FIG. 7).

According to possible forms of embodiment of the production method according to the present invention, it may be provided that, in the event of an interruption to the rolling process, for example due to incidents or rolling roll changes, the aerial transfer device 31 takes the billets for example:

toward the maintenance and/or heating furnace 25, for example on the introduction path 29 (see for example FIGS. 1-6) or on the single movement path 35 (see for example FIG. 7);

or on the discharge plate 34, where the billets can cool;

or in sequential combinations of the destinations as above.

According to one feature of the present invention, at the end of the daily rolling sequence of the production method described here, a part of the time is reserved, for example a fraction of an hour, to recall the billets that have accumulated in the maintenance and/or heating furnace 25 and feed them to the rolling mill 12 as well.

In some variants it may be hypothesized that the billets that have accumulated for example at the discharge plate 34 may be recalled.

In possible forms of embodiment, the present invention may provide to load cold billets in the maintenance and/or heating furnace 25, and keep them inside for a suitable time, which may be comprised between about 1 hour and about 20 hours, typically between about 2 hours and 15 hours, for example about 3 hours, so that they are heated to the desired temperature and can therefore be processed in the rolling mill 12 provided downstream. This operation, according to the present invention, can be performed when the maintenance and/or heating furnace 25 is not yet full, that is, when it has only been partly filled but its accumulation limit has not been reached, or also when it is completely empty.

In this way, according to some forms of embodiment of the present invention, it is possible to feed the rolling mill 12 always at the end of the daily production cycle with billets previously produced and accumulated on the discharge plate 34, or in the collection zone.

In some forms of embodiment of the present invention, it may be advantageous to adopt a policy of managing the accumulation in the maintenance and/or heating furnace 25 so that the latter is filled with billets and always kept full during the production cycle, that is, it is filled to saturation and kept this way for example until the end of the daily rolling sequence. Consequently, in forms of embodiment described here, FIFO- or LIFO-type logics are not adopted for the management and movement of the billets to/from the maintenance and/or heating furnace 25, but instead the latter is filled and kept full until the end of the daily rolling cycle, after which it is emptied.

If during a production campaign no incidents occur, for example cobbles, on the rolling mill 12, or if no programmed stoppages are made, in order to carry out roll-changes for example, then the temperature maintenance and/or heating furnace 25 would normally remain empty, when adopting traditional management criteria. On the contrary, forms of embodiment of the present invention may provide, for each daily work cycle, to fill the maintenance and/or heating furnace 25 completely in any case, even if there are no interruptions to the rolling, by introducing billets therein, for example taking them either from the discharge plate 34, if there are any there, or from the collection zone, and keeping them inside for at least a suitable time, for example at least two hours, in particular at least 3 hours, for example between about 2 and 15 hours. Some forms of embodiment of the present invention can also provide a mixed accumulation in the maintenance and/or heating furnace 25 of hot and cold billets.

Therefore, in some forms of embodiment which provide management policies of the maintenance and/or heating furnace 25 which is kept full during the daily cycle, it is advantageously possible to recover all the billets that have accumulated over time downstream of the continuous casting machine 11, for example following discontinuities in the co-rolling process as a result of stoppages of the rolling mill. The billets are processed in the rolling mill 12 at constant intervals, programmable over time, for example at the end of a daily rolling cycle.

In this way, thanks in particular to the maintenance and/or heating furnace 25 and the discharge plate 34, the present invention allows to obtain the following benefits:

to reduce to the minimum, or eliminate, the discards of material in emergency situations or during programmed stoppages;

to guarantee high yield, equal to the ratio between the weight of the finished product and the weight of the liquid steel to produce one ton;

to obtain a greater stability of the rolling train and better dimensional quality of the finished product;

to guarantee the possibility of changes of production in size and type, without stopping the continuous casting, obtaining a high use factor of the plant, without loss of production and without penalizing the steelworks upstream;

to exploit to the utmost the enthalpy possessed by the original liquid steel along the whole production line in order to obtain a considerable energy saving and a reduction in running costs compared with conventional processes.

Furthermore, by providing the aerial transfer device 31, the present invention allows:

to feed the maintenance and/or heating furnace 25 on the introduction path 29, or on the single movement path 35, depending on the variants;

to pick up billets from the discharge roll path 30, or from the single movement path 35, depending on the variants, of the maintenance and/or heating furnace 25 so as then to feed one or more rolling lines 12*a*, 112*a*, 112*b*, possibly assuming an intermediate position at the billet-turner device 40;

to move billets onto the discharge plate 34;

to remove billets from the discharge plate 34;

to transfer the billets from one rolling line 112*a*, 112*b* to another.

In this way, maximum flexibility is obtained in managing the billets, and it is therefore possible to deal with a wide spectrum of different functioning conditions of the steel plant 10.

It is clear that modifications and/or additions of parts may be made to the steel plant 10 and production method as described heretofore, without departing from the field and scope of the present invention.

It is also clear that, although the present invention has been described with reference to some specific examples, a person of skill in the art shall certainly be able to achieve many other equivalent forms of steel plant and production method, having the characteristics as set forth in the claims and hence all coming within the field of protection defined thereby.

The invention claimed is:

1. Steel plant for the production of long metal products comprising:

a continuous casting machine;

a rolling mill disposed downstream of the continuous casting machine;

one or more transfer paths for the semifinished cast products, configured to connect the continuous casting machine and the rolling mill;

and further comprising:

at least one maintenance and/or heating furnace to maintain at temperature and/or to heat semifinished cast products, disposed near the transfer paths;

a discharge plate for the semifinished cast products;

an aerial transfer device configured to transfer rapidly by aerial path semifinished cast products between the one or more transfer paths, the maintenance and/or heating furnace and the discharge plate;

wherein said maintenance and/or heating furnace and said discharge plate are positioned externally to the continuous casting machine and the rolling mill, on reciprocally opposite sides with respect to a work axis defined by the continuous casting machine and the rolling mill, and in that said aerial transfer device is configured mobile transversely to the work axis, in order to serve the maintenance and/or heating furnace and the discharge plate; and further wherein said continuous casting machine and said rolling mill comprise respectively a single casting line and a single rolling line aligned along said work axis and connected to each other by a transfer path, wherein said discharge plate is located laterally in proximity to said transfer path and said aerial transfer device is configured to slide above at least said transfer path and said discharge plate transversely to said work axis.

2. Steel plant as in claim 1, wherein said maintenance and/or heating furnace at least partly overlaps the one or more transfer paths between the continuous casting machine and the rolling mill and said discharge plate is positioned laterally outside said continuous casting machine, and in that said aerial transfer device is configured mobile transversely so as to slide both above said continuous casting machine and also above said discharge plate.

3. Steel plant as in claim 1, wherein said aerial transfer device is provided with gripping and support members, translatable vertically in order to grip and support semifinished cast products as it moves.

4. Steel plant for the production of long metal products comprising:

a continuous casting machine;

a rolling mill disposed downstream of the continuous casting machine;

one or more transfer paths for the semifinished cast products, configured to connect the continuous casting machine and the rolling mill;

and further comprising:

at least one maintenance and/or heating furnace to maintain at temperature and/or to heat semifinished cast products, disposed near the transfer paths;

a discharge plate for the semifinished cast products;

an aerial transfer device configured to transfer rapidly by aerial path semifinished cast products between the one or more transfer paths, the maintenance and/or heating furnace and the discharge plate;

wherein said maintenance and/or heating furnace and said discharge plate are positioned externally to the continuous casting machine and the rolling mill, on reciprocally opposite sides with respect to a work axis defined by the continuous casting machine and the rolling mill, and in that said aerial transfer device is configured mobile transversely to the work axis, in order to serve the maintenance and/or heating furnace and the discharge plate; and further wherein said continuous casting machine and said rolling mill comprise respectively two casting lines and two rolling lines aligned with each other along at least a work direction, which defines the direction of the flow of material from the continuous casting machine to the rolling mill, and connected by two transfer paths, wherein said discharge plate is located laterally and externally in proximity to one of said transfer paths and said aerial transfer device slides above at least said transfer paths and said discharge plate.

5. Steel plant as in claim 4, wherein said two casting lines and at least first segments of said two rolling lines are divergent with respect to each other, along respective work directions, with respect to said work axis, and in that it comprises a billet-turner device, positioned in an intermediate zone between the transfer paths and configured to align semifinished cast products and to dispose them parallel to said work axis, said aerial transfer device being configured to transfer semifinished cast products towards and from said billet-turner device.

6. Steel plant as in claim 4, wherein said two casting lines and said two rolling lines are parallel with respect to each other and to said work axis.

7. Steel plant as in claim 4, wherein said aerial transfer device is configured mobile along a direction orthogonal to said work axis and/or to at least one work direction.

8. Method for the production of long metal products, comprising continuous casting, rolling downstream of the continuous casting and transfer of semifinished cast products by means of one or more transfer paths from continuous casting to rolling, and further comprising:

maintaining at temperature and/or heating semifinished cast products in a maintenance and/or heating furnace at the one or more transfer paths between casting and rolling;

discharging semifinished cast products in a discharge plate;

rapid transfer by aerial path of semifinished cast products between the one or more transfer paths, the maintenance and/or heating furnace and the discharge plate;

further comprising positioning semifinished cast products in segments on the one or more transfer paths, subsequently to pick up said semifinished cast products from the one or more transfer paths, to transfer by aerial path said semifinished cast products toward the maintenance and/or heating furnace, to maintain said semifinished cast products in the maintenance and/or heating furnace, to transfer said semifinished cast products by aerial path from the maintenance and/or heating furnace toward the one or more transfer paths and to send said semifinished cast products for rolling, where they are rolled; and further wherein, after positioning said semifinished cast products on the one or more transfer paths, and before transferring the semifinished cast products to said maintenance and/or heating furnace, the method provides to transfer by aerial path said semifinished cast products toward the discharge plate.

9. Method as in claim 8, wherein the method provides to transfer semifinished cast products to said maintenance and/or heating furnace both when said maintenance and/or heating furnace is completely empty, and also when it is partly filled, until it is completely filled.

10. Method as in claim 8, wherein on a daily production cycle basis, the method keeps the maintenance and/or heating furnace completely filled with semifinished cast products, and provides to discharge other semifinished cast products at the discharge plate and, at end-of-cycle, to pick up the semifinished cast products from the maintenance and/or heating furnace and from the discharge plate and to roll the respective semifinished cast products.

11. Method as in claim 8, wherein the method provides to keep semifinished cast products inside the maintenance and/or heating furnace for at least 2 hours.

* * * * *